US009202656B2

(12) United States Patent
Salonga et al.

(10) Patent No.: US 9,202,656 B2
(45) Date of Patent: Dec. 1, 2015

(54) FUSE WITH CAVITY BLOCK

(75) Inventors: Bienvenido Salonga, Batangas (PH); Simon Jude Burgos, Iligan (PH); Aileen Dimafelix, Bantagas (PH); Janus Pagharion, Paranaque (PH); Roel Retardo, Batangas (PH); Dennis Arce, Paranagul (PH); Dan Onken, Chatham, IL (US)

(73) Assignee: LITTELFUSE, INC., Chicago, IL (US)

( * ) Notice: Subject to any disclaimer, the term of this patent is extended or adjusted under 35 U.S.C. 154(b) by 256 days.

(21) Appl. No.: 13/282,638

(22) Filed: Oct. 27, 2011

(65) Prior Publication Data

US 2013/0106564 A1 May 2, 2013

(51) Int. Cl.

| | |
|---|---|
| ***H01H 85/04*** | (2006.01) |
| ***H01H 85/00*** | (2006.01) |
| ***H01H 85/041*** | (2006.01) |
| ***H01H 85/165*** | (2006.01) |

(52) U.S. Cl.

CPC ..... *H01H 85/003* (2013.01); *H01H 85/0411* (2013.01); *H01H 85/165* (2013.01); *H01H 2085/0414* (2013.01)

(58) Field of Classification Search

CPC ..... H01H 85/003; H01H 85/165; H01H 85/0411; H01H 2085/0414

USPC ..... 337/186, 187, 190, 205, 227, 228, 231, 337/234, 236, 246, 248, 251–253

See application file for complete search history.

(56) References Cited

U.S. PATENT DOCUMENTS

| | | | | |
|---|---|---|---|---|
| 3,460,086 | A * | 8/1969 | Fister | 337/202 |
| 4,035,753 | A | 7/1977 | Reeder | |
| 4,237,440 | A | 12/1980 | Miyasaka et al. | |
| 4,540,969 | A * | 9/1985 | Sugar | 337/232 |
| 4,563,809 | A | 1/1986 | Reeder | |
| 4,656,453 | A | 4/1987 | Reeder | |
| 4,680,567 | A | 7/1987 | Edwards | |
| 4,703,299 | A * | 10/1987 | Vermij | 337/158 |
| 4,703,300 | A | 10/1987 | Gaia | |
| 4,873,506 | A | 10/1989 | Gurevich | |
| 4,918,420 | A | 4/1990 | Sexton | |
| 5,077,534 | A | 12/1991 | Douglass | |
| 5,150,093 | A | 9/1992 | Gurevich | |
| 5,166,656 | A | 11/1992 | Badihi et al. | |
| 5,198,792 | A | 3/1993 | Bacon et al. | |
| 5,214,406 | A * | 5/1993 | Reese et al. | 337/231 |
| 5,228,188 | A | 7/1993 | Badihi et al. | |
| 5,235,307 | A | 8/1993 | Oh | |
| 5,296,833 | A | 3/1994 | Breen et al. | |

(Continued)

FOREIGN PATENT DOCUMENTS

| | | |
|---|---|---|
| JP | 57204635 S | 12/1982 |
| JP | 61200640 S | 9/1986 |

(Continued)

OTHER PUBLICATIONS

International Search Report for PCT/US2012/61579, Dated Jan. 9, 2013.

*Primary Examiner* — Anatoly Vortman

(74) *Attorney, Agent, or Firm* — Kacvinsky Daisak Bluni PLLC

(57) ABSTRACT

An improved fuse including a fuse body, a fusible element, end terminations and insulated plugs used to seal a cavity formed within the fuse body to extinguish electrical arcs when an overcurrent condition occurs.

6 Claims, 6 Drawing Sheets

(56) References Cited

U.S. PATENT DOCUMENTS

| | | | | |
|---|---|---|---|---|
| 5,432,378 | A | 7/1995 | Whitney et al. | |
| 5,552,757 | A | 9/1996 | Blecha et al. | |
| 5,617,069 | A | 4/1997 | Arikawa et al. | |
| 5,664,320 | A | 9/1997 | Gurevich | |
| 5,812,046 | A | 9/1998 | Brown et al. | |
| 6,507,265 | B1 | 1/2003 | Ackermann | |
| 6,778,061 | B2 * | 8/2004 | Nakano et al. | 337/248 |
| 6,798,330 | B2 * | 9/2004 | Arikawa et al. | 337/231 |
| 7,138,899 | B2 * | 11/2006 | Jollenbeck et al. | 337/281 |
| 7,250,843 | B2 * | 7/2007 | Richter et al. | 337/250 |
| 8,368,502 | B2 * | 2/2013 | Washizaki et al. | 337/297 |
| 2005/0057337 | A1 | 3/2005 | Richter et al. | |
| 2007/0019351 | A1 | 1/2007 | Whitney et al. | |
| 2009/0309689 | A1 | 12/2009 | Pavlovic et al. | |

FOREIGN PATENT DOCUMENTS

| | | | |
|---|---|---|---|
| JP | 62131431 | S | 6/1987 |
| JP | 07192593 | H | 7/1995 |
| JP | 08106845 | H | 4/1996 |
| JP | 08222117 | H | 8/1996 |
| JP | 10177835 | H | 6/1998 |
| JP | 11204004 | H | 7/1999 |
| JP | 2002100272 | A | 4/2002 |
| JP | 2003123609 | A | 4/2003 |
| JP | 2006164979 | A | 6/2006 |
| JP | 2010015715 | A | 1/2010 |
| JP | 2011508407 | A | 3/2011 |

* cited by examiner

FUSE WITH CAVITY BLOCK

BACKGROUND OF THE INVENTION

1. Field of the Invention

Embodiments of the invention relate to the field of circuit protection devices. More particularly, the present invention relates to a fuse having insulated plugs used to seal a cavity formed within a fuse body to extinguish electrical arcs when an overcurrent condition occurs.

2. Discussion of Related Art

Fuses are used as circuit protection devices and form an electrical connection with a component in a circuit to be protected. One type of fuse includes a fusible element disposed within a hollow fuse body. When an occurrence of a specified fault condition occurs, the fusible element melts or otherwise opens to interrupt the circuit path and isolate the protected electrical components or circuit from potential damage. Fuses may be characterized by the amount of time required to respond to an overcurrent condition. In particular, fuses that comprise different fusible elements respond with different operating times since different fusible elements can accommodate varying amounts of current through the element. Thus, by varying the size and type of fusible element, different operating times may be achieved.

When an overcurrent condition occurs, an arc may be formed between the melted portions of the fusible element. If not extinguished, this arc may further damage the circuit to be protected by allowing unwanted current to flow to circuit components. Thus, it is desirable to manufacture fuses which extinguish this arc as quickly as possible. In addition, as fuses become smaller and smaller to accommodate electrical circuits, there is a need to reduce manufacturing costs of these fuses. This may include reducing the number of components and/or less expensive components as well as reducing the number and/or complexity of associated manufacturing steps.

Consequently, there is a need to reduce the number of components and/or manufacturing steps to produce a fuse with improved arc extinguishing characteristics. It is with respect to these and other considerations that the present improvements have been needed.

SUMMARY OF THE INVENTION

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments are generally directed to a fuse having a fuse body formed of an electrically insulating material. The fuse body defines a cavity which extends from a first end of the fuse body to a second end of the fuse body. A fusible element is disposed within the cavity and extends from a first end face of the first end of the fuse body to a second end face of the second end of the fuse body. Insulated plugs are disposed within the cavity at the first and second ends wherein the plugs form a seal closing the internal cavity. First and second end terminations cover respective first and second end faces of the fuse body. The first end termination is in electrical contact with the fusible element at the first end face and the second end termination is in electrical contact with the fusible element at the second end face. Other embodiments are described and claimed.

DESCRIPTION OF EMBODIMENTS

Figure 1A:
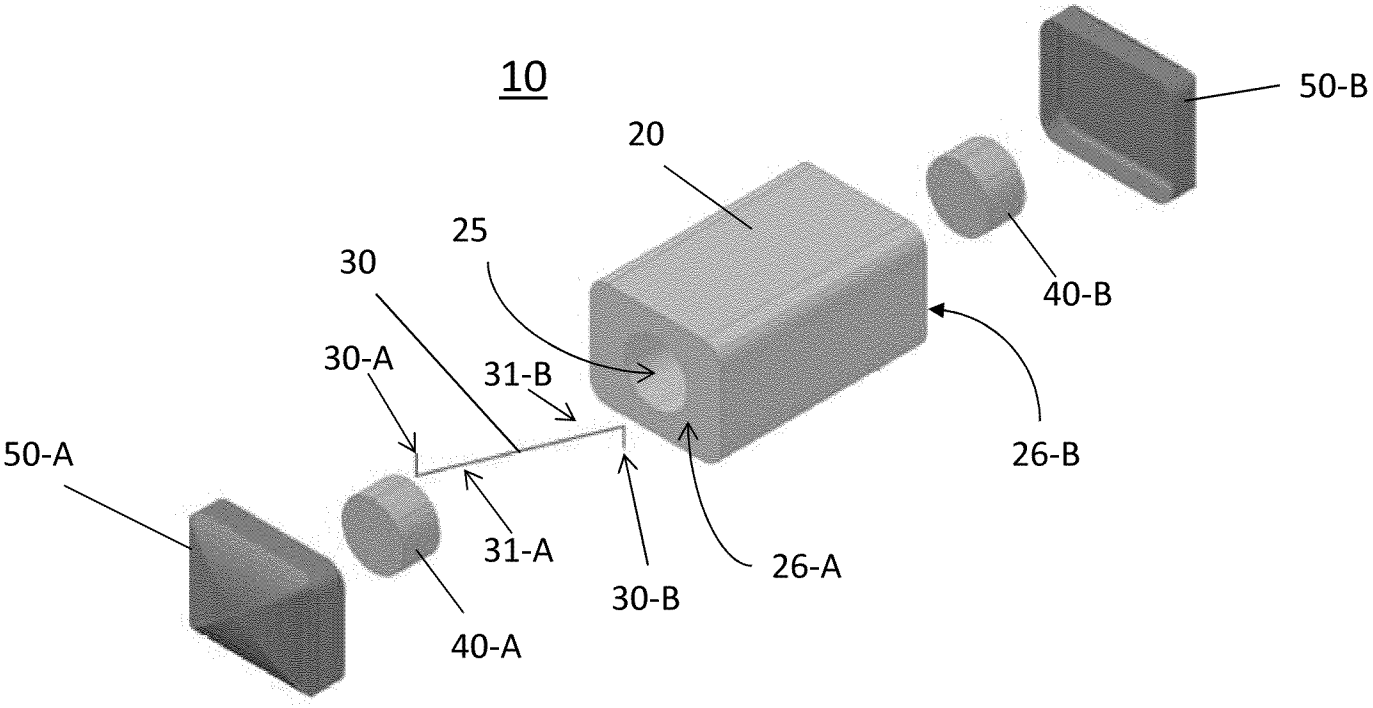
FIG. 1A illustrates a perspective exploded view of an exemplary fuse.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1A is a perspective exploded view of an exemplary fuse 10 in accordance with the present disclosure. The fuse 10 includes a fuse body 20 which defines a cavity 25 extending from a first end face 26-A to a second end face 26-B. The shape of the fuse body 20 can be, for example, rectangular, cylindrical, etc., with various cross-sectional configurations. The fuse body 20 may be formed from an electrically insulating material such as, for example, glass, ceramic, plastic, etc. The fuse 10 includes a fusible element 30 disposed within the cavity 25 which extends from the first end face 26-A of the fuse body 20 to the second end face 26-B. In particular, the fusible element 30 has a first end 30-A which is bent or otherwise contiguous with respective end face 26-A of fuse body 20 and a second end 30-B which is also bent or otherwise contiguous with respective end face 26-B of fuse body 20. Fusible element 30 may be disposed within cavity 25 of fuse body 20 in a diagonal configuration from the end face 26-A to end face 26-B. Fusible element 30 is configured to melt or otherwise cause an open circuit under certain overcurrent conditions. The fusible element 30 may be a wire, metal link, spiral wound wire, a film, an electrically conductive core deposited on a substrate or any other suitable configuration to provide a circuit interrupt.

Fuse 10 also includes insulated plugs 40-A and 40-B which are disposed within cavity 25 at respective ends of the fuse body 20. Insulated plugs may be an adhesive material disposed in cavity 25 to close openings thereto at respective ends of the fuse body 20. In particular, insulated plugs 40-A, 40B may be a ceramic adhesive dispensed in cavity 25 after fusible element 30 is positioned within fuse body 20. In addition, insulated plugs 40-A, 40-B may be positioned to allow the respective ends 30-A and 30-B of fusible element 30 to be disposed between the plugs and an inside surface of cavity 25 of fuse body 20 to allow ends 30-A and 30-B to extend to surface 26-A and 26-B respectively. In particular, portion 31-A of fusible element 30 proximate first end 30-A is positioned between insulated plug 40-A and a surface of cavity 25 of fuse body 20 to allow end 30-A of the fusible element to extend out from cavity 25 and be disposed on surface 26-A of fuse body 20. Similarly, portion 31-B of fusible element 30 proximate second end 30-B is positioned between insulated plug 40-B and a surface of cavity 25 of fuse body 20 to allow end 30-B of the fusible element to extend out from cavity 25 and be disposed on surface 26-B of fuse body 20.

Fuse 10 includes first 50-A and second 50-B end terminations disposed on the first 26-A and second 26-B end faces, respectively, of fuse body 20 which also covers insulated plugs 40-A, 40-B. In particular, the first end termination 50-A is in electrical contact with at least end 30-A of fusible element 30 at end face 26-A and the second end termination 50-B is in electrical contact with at least end 30-B of fusible element 30 at end face 26-B. In this manner, a current path is defined between the end terminations 50-A, 50-B and fusible element 30. First and second end terminations 50-A, 50-B may be a silver paste applied to the ends of the fuse body 20. Each of the end terminations 50-A and 50-B connect the fuse 10 in an electrical circuit. The end terminations 50-A and 50-B may also be plated with nickel (Ni) and/or tin (Sn) to accommodate soldering of the fuse 10 to a circuit board or other electrical circuit connection.

Figure 1B:
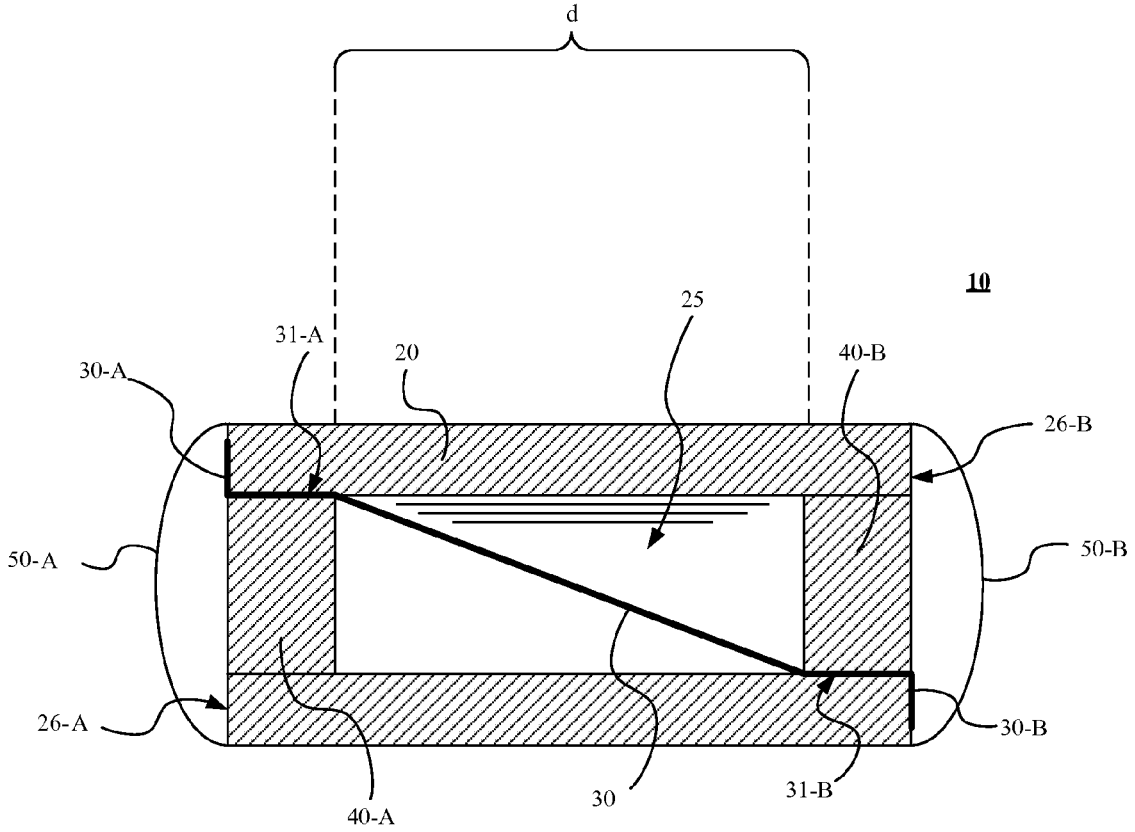
FIG. 1B illustrates a side cross sectional view of assembled fuse.

FIG. 1B illustrates a side cross sectional view of assembled fuse 10. As can be seen, fusible element 30 is oriented diagonally within cavity 25 of fuse body 20 with end 30-A disposed on end face 26-A, and end 30-B disposed on end face 26-B. Insulated plug 40-A is disposed within cavity 25 with portion 31-A of the fusible element 30 being disposed between plug 40-A and a surface of cavity 25 of fuse body 20. Similarly, insulated plug 40-B is disposed within cavity 25 with portion 31-B of the fusible element 30 being disposed between plug 40-B and a surface of cavity 25 of fuse body 20. When an overcurrent condition occurs, the fusible element 30 melts which interrupts the circuit to which it is connected. When the fusible element melts, an electric arc may form between the un-melted portions of the fusible element 30 remaining within cavity 25 forming an arc channel. The arc channel continues or grows until the voltage in the circuit is lower than that required to maintain the arc and it is subsequently extinguished. The insulated plugs 40-A, 40-B serve to reduce this arc channel within cavity 25 by decreasing the length "d" of cavity 25 defined between insulated plugs 40-A and 40-B as well as providing an insulated seal at respective ends of the fuse body 20 thereby ceasing the fault current quickly. In addition, the insulated plugs 40-A, 40-B may be made from a ceramic adhesive which do not have gas evolving properties. Therefore, when an overcurrent condition occurs and an arc is generated, the insulated plugs 40-A, 40-B do not emit gas into cavity 25 which would otherwise feed the arc.

End termination 50-A is disposed over end face 26-A of fuse body 20, end 30-A of fusible element 30 and insulated plug 40-A. End termination 50-B is disposed over end face 26-B of fuse body 20, end 30-B of fusible element 30 and insulated plug 40-B. As mentioned above, end terminations 50-A, 50-B may be made from a silver paste applied to respective ends of the fuse body 20. The insulated plugs 40-A, 40-B provide a surface for the end terminations 50-A, 50-B, respectively, to be deposited on. Otherwise, multiple applications of a layered paste such as, for example, silver would have to be deposited and each layer subsequently dried before another deposition of paste is applied in order to close or seal the ends of cavity 25 before end terminations 50-A, 50-B are disposed over respective end faces 26-A, 26-B. Thus, the use of insulated plugs reduces manufacturing time and associated costs by avoiding multiple deposition of layers to seal cavity 25 and providing a surface for end terminations 50-A and 50-B.

Figure 2A:
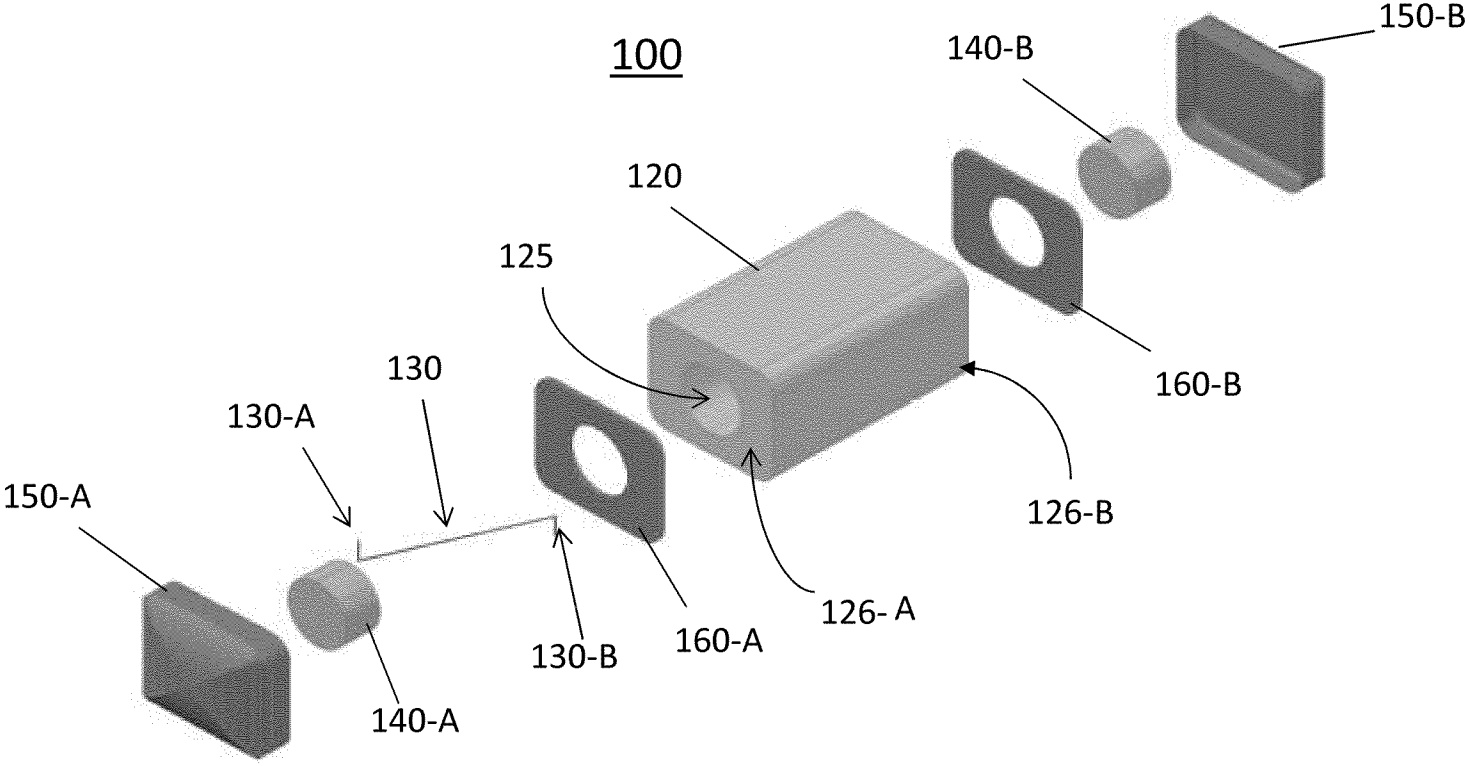
FIG. 2A is a perspective exploded view of an exemplary fuse.

FIG. 2A illustrates an exploded perspective view of an alternative exemplary embodiment of fuse 100. The fuse 100 includes a fuse body 120 which defines a cavity 125 extending from a first end face 126-A to a second end face 126-B. As mentioned above, fuse body 120 may be formed from an electrically insulating material such as, for example, glass, ceramic, plastic, etc. A fusible element 130 is disposed within cavity 125 which extends from the first end face 126-A of the fuse body 120 to the second end face 126-B. The fusible element 130 has a first end 130-A which is bent or otherwise contiguous with respective end face 126-A of fuse body 120 and a second end 130-B which is also bent or otherwise contiguous with respective end face 126-B of fuse body 120. The ends 130-A, 130-B of fusible element 130 is shown as being spaced away from respective end faces 126-A, 126-B, however, this is shown for explanatory purposes. Ends 130-A, 130-B of fusible element 130 are disposed on respective end faces 126-A, 126-B of fuse body 120. As noted above, fusible element 130 is configured to melt or otherwise cause an open circuit under certain overcurrent conditions depending on the fuse rating.

A metalized coating 160-A is disposed on the end face 126-A of fuse body 120 and is in electrical contact with end 130-A of fusible element 130. Similarly, metalized coating 160-B is disposed on the end face 126-B of fuse body 120 and is in electrical contact with end 130-B of fusible element 130. The metalized coatings are not deposited on the surface of the cavity 125 of fuse body 120. The metalized coatings 160-A, 160-B also assists in forming an electrical contact between ends 130-A, 130-B of fusible element 130 and respective end terminations 150-A, 150-B as described below. Insulated plugs 140-A and 140-B are disposed within cavity 125 at respective ends of the fuse body 120. As mentioned above, insulated plugs 140-A, 140B may be a ceramic adhesive dispensed in cavity 125 after fusible element 130 is positioned within fuse body 120 with ends 130-A and 130-B disposed on respective end faces 126-A, 126-B. Metalized coatings 160-A, 160-B are applied to end faces 126-A, 126-B, respectively. Insulated plugs 140-A, 140-B are positioned to allow the respective ends 130-A and 130-B of fusible element 130 to be disposed between the plugs and an inside surface of cavity 125 of fuse body 120 to allow ends 130-A and 130-B to extend to surface 126-A and 126-B respectively.

Fuse 100 includes first 150-A and second 150-B end terminations disposed on the first 126-A and second 126-B end faces of fuse body 120 which also covers respective insulated plugs 140-A, 140-B. In particular, the first end termination 150-A is in electrical contact with end 130-A of fusible element 130 and metalized coating 160-A at end face 126-A of fuse body 120. Second end termination 150-B is in electrical contact with end 130-B of fusible element 130 and metalized coating 160-B at end face 126-B of fuse body 120. In this manner, a current path is defined between the end terminations 150-A, 150-B and fusible element 130 via metalized coatings 160-A, 160-B. Each of the end terminations 150-A and 150-B connect the fuse 100 in an electrical circuit.

Figure 2B:
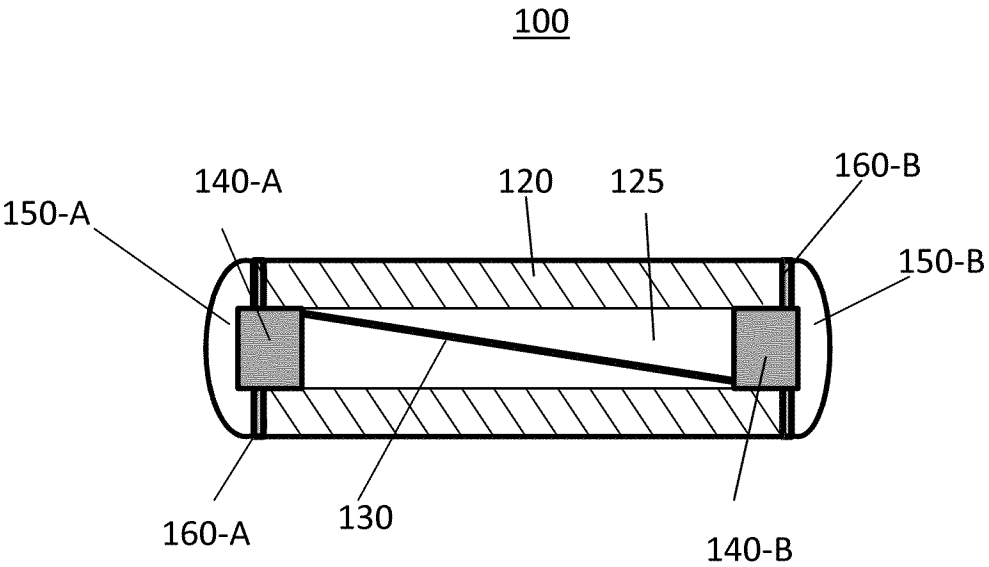
FIG. 2B illustrates a side cross sectional view of assembled fuse.

FIG. 2B illustrates a side cross sectional view of assembled fuse 100 wherein fusible element 130 is oriented diagonally within cavity 125 of fuse body 120 with end 130-A disposed on end face 126-A, and end 130-B disposed on end face 126-B. Metalized coating 160-A is disposed on end face 126-A and forms an electrical connection between end 130-A of fusible element 130 and end termination 150-A. Similarly, metalized coating 160-B is disposed on end face 126-B and forms an electrical connection between end 130-B of fusible element 130 and end termination 150-B. Insulated plug 140-A is disposed within cavity 125 which seals cavity 125 from end termination 150-A and insulated plug 140-B is disposed within cavity 125 which seals cavity 125 from end termination 150-B. When an overcurrent condition occurs, the fusible element 130 melts which interrupts the circuit to which it is connected. When the fusible element melts, an electric arc may form between the un-melted portions of the fusible element 130 remaining within cavity 125. The insulated plugs 140-A, 140-B serve to reduce this arc within cavity 125 by decreasing the length of cavity 125 as well as providing an insulated seal at respective ends of the fuse body 120 thereby ceasing the fault current quickly. In addition, the insulated plugs 140-A, 140-B may be made from a ceramic adhesive which does not have gas evolving properties. Therefore, when an overcurrent condition occurs and an arc is generated, the insulated plugs 140-A, 140-B do not emit gas into cavity 125 which would otherwise feed the arc.

Included herein are flow chart(s) representative of exemplary methodologies for performing novel aspects of the present disclosure. While, for purposes of simplicity of explanation, the one or more methodologies shown herein, for example, in the form of a flow chart or logic flow, are shown and described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events. Moreover, not all acts illustrated in a methodology may be required for a novel implementation.

Figure 3:
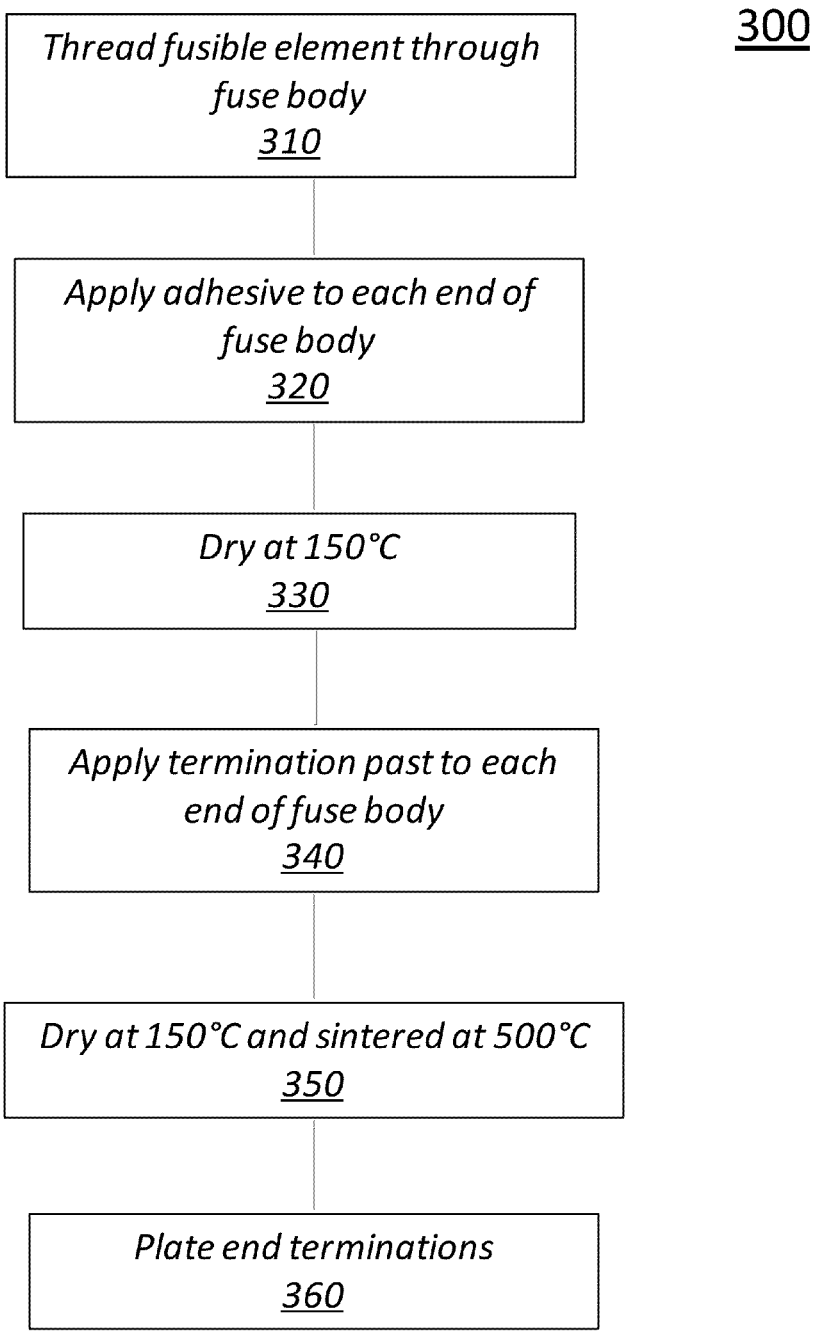
FIG. 3 illustrates a logic flow in connection with the fuse shown in FIGS. 1A, 1B.

FIG. 3 illustrates one embodiment of a logic flow 300 in connection with the fuse 10 shown in FIG. 1A, 1B. A fusible element is threaded through the fuse body at step 310. For example, fusible element 30 is threaded through fuse body 20 where ends 30-A and 30-B are disposed on end faces 26-A and 26-B. A ceramic adhesive is deposited within cavity 25 of fuse body 20 at step 320. The ceramic adhesive adheres to the interior surface of cavity 25 and serves to close or seal cavity 25. The adhesive is dried at, for example, 150° C. for a predetermined time period at step 330. End terminations 50-A, 50-B in the form of a silver termination paste are applied to each end of fuse body 20 at step 340. The end terminations 50-A, 50-B are dried at 150° C. and sintered at 500° C. at step 350. The end terminations 50-A, 50-B may be plated with Nickel (Ni) and/or Tin (Sn) at step 360 to accommodate solderability of fuse 10 to one or more electrical connections.

Figure 4:
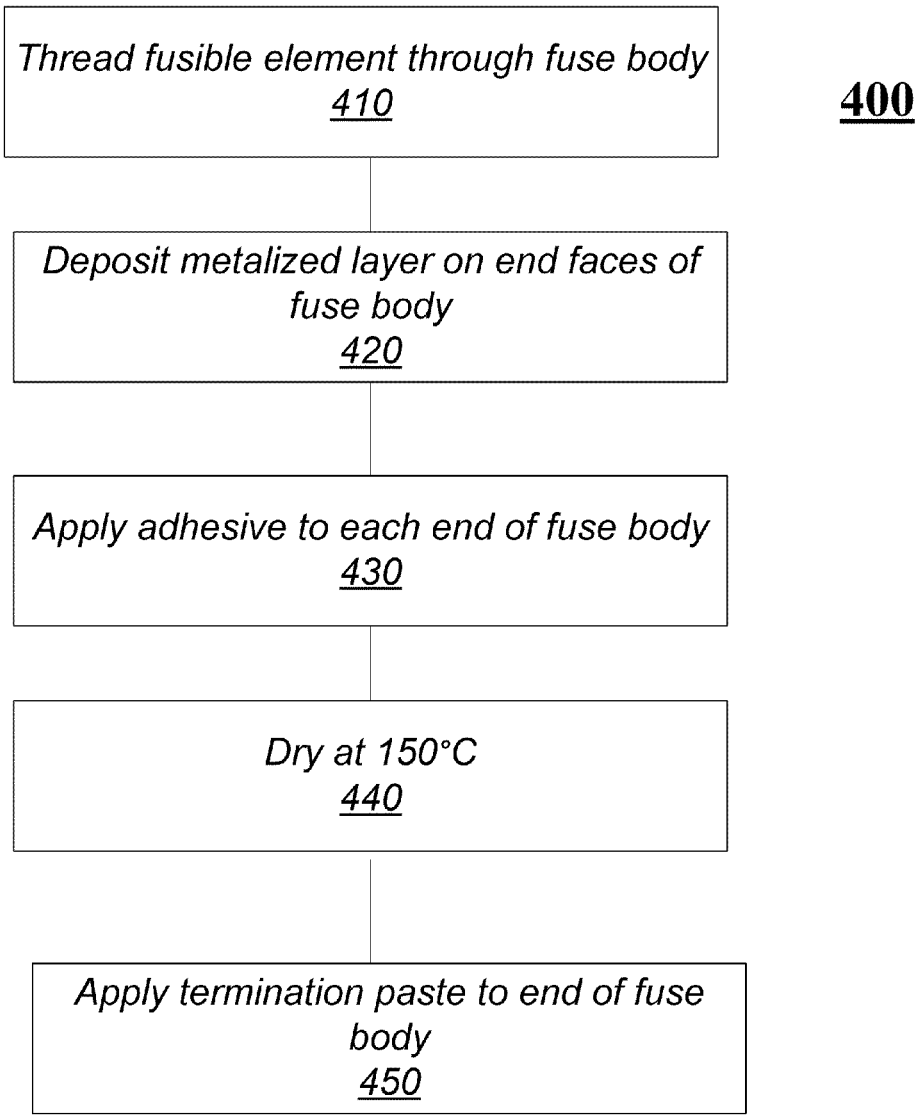
FIG. 4 illustrates a logic flow in connection with the fuse shown in FIGS. 2A, 2B.

FIG. 4 illustrates one embodiment of a logic flow 400 in connection with fuse 100 shown in FIGS. 2A, 2B. A fusible element is threaded through the fuse body at step 410. For example, fusible element 130 is threaded through fuse body 120 where ends 130-A and 130-B of fusible element 130 are disposed on end faces 126-A and 126-B. A metalized layer is deposited on end faces 126-A, 126-B of fuse body 120 at step 420. A ceramic adhesive is deposited within cavity 125 of fuse body 120 at step 430. The ceramic adhesive adheres to the interior surface of cavity 125 and serves to close or seal cavity 125. The adhesive is dried at, for example, 150° C. for a predetermined time period at step 440. End terminations 150-A, 150-B in the form of a silver termination paste are applied to each end of fuse body 120 at step 450.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed is:

1. A fuse comprising:

a fuse body formed of electrically insulating material defining a cavity extending from a first end of the fuse body to a second end of the fuse body;

a fusible element disposed within the cavity and extending from a first end face of the first end of the fuse body to a second end face of the second end of the fuse body;

a metalized coating disposed on the first and second end faces of the fuse body in electrical contact with a respective end of the fusible element;

a first portion of the fuse element proximate to a first end of the fuse element, the first portion is disposed between a first insulated plug and an inside surface of the cavity;

the first end of the fuse element extending out from the cavity at the first end of the fuse body and bent away from the first insulated plug, the first end of the fuse element disposed on and terminates at the first end face of the fuse body and in electrical contact with the metalized coating disposed on the first end face;

a second portion of the fuse element proximate to a second end of the fuse element, the second portion is disposed between a second insulated plug and an inside surface of the cavity;

the second end of the fuse element extending out from the cavity at the second end of the fuse body and bent away from the second insulated plug, the second end of the fuse element disposed on and terminates at the second end face of the fuse body and in electrical contact with the metalized coating disposed on the second end face;

the first and second insulated plugs bonded to an internal surface of the cavity at the first and second ends wherein the first and second insulated plugs form a seal closing the internal cavity; and the first and second end terminations formed of an electrically conductive paste layer deposited on a surface of respective insulated plugs at the first and second ends of the fuse body, the first end termination in electrical contact with the first end of the fusible element at the first end face and the second end termination in electrical contact with the second end of the fusible element at the second end face.

2. The fuse of claim 1 wherein the first and second end terminations are each plated with a metal material to accommodate connection of the fuse to electrical contacts.

3. The fuse of claim 1 wherein the insulated plugs are formed of a ceramic adhesive having no gas evolving properties when said plugs are exposed to an electrical arc condition within the fuse body.

4. The fuse of claim 1 wherein the insulated plugs are formed of a ceramic material having no gas evolving properties when said plugs are exposed to an electrical arc condition within the fuse body.

5. The fuse of claim 1 wherein the fusible element extends diagonally within the cavity from the first end to the second end.

6. The fuse of claim 1 wherein the first end termination covers the first insulated plug and the second end termination covers the second insulated plug.

* * * * *